US010219066B2

(12) United States Patent
Gougherty et al.

(10) Patent No.: US 10,219,066 B2
(45) Date of Patent: Feb. 26, 2019

(54) INTERCHANGEABLE WEARING MODES FOR A HEADSET

(71) Applicant: Plantronics, Inc., Santa Cruz, CA (US)

(72) Inventors: Stefan Gougherty, Oakland, CA (US); John Kelley, Santa Cruz, CA (US); Erik Tews, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 277 days.

(21) Appl. No.: 14/033,764

(22) Filed: Sep. 23, 2013

(65) Prior Publication Data

US 2015/0086059 A1 Mar. 26, 2015

(51) Int. Cl.
*H04R 1/10* (2006.01)

(52) U.S. Cl.
CPC ..... *H04R 1/1066* (2013.01); *H04R 1/105* (2013.01)

(58) Field of Classification Search
CPC ..... H04R 1/105
USPC ..... 381/370, 373
See application file for complete search history.

(56) References Cited

U.S. PATENT DOCUMENTS 4,420,657 A 12/1983 Larkin
5,018,599 A * 5/1991 Dohi ..... H04R 1/1008 181/129
5,367,345 A 11/1994 da Silva
5,450,496 A 9/1995 Burris et al.
5,708,724 A * 1/1998 Burris et al. ..... 381/370
5,862,241 A * 1/1999 Nelson ..... H04R 1/105 381/374
6,434,250 B1 * 8/2002 Tsuhako ..... 381/374
7,120,247 B1 * 10/2006 Wade ..... H04M 1/05 379/430
2004/0066948 A1 * 4/2004 Bogeskov-Jensen ... H04M 1/05 381/376
2007/0044205 A1 * 3/2007 Sato ..... A61F 11/14 2/209
2009/0010474 A1 * 1/2009 Ouryouji ..... H04R 1/1058 381/370
2011/0019859 A1 * 1/2011 Van Der Beek ..... H04R 1/1016 381/375

* cited by examiner

*Primary Examiner* — Duc Nguyen
*Assistant Examiner* — Phan Le
(74) *Attorney, Agent, or Firm* — Thomas S. Dienwiebel; Slayden Grubert Beard PLLC

(57) ABSTRACT

A headset system for interchangeable wearing styles is disclosed. A retention element is detachably coupled to an earpiece, allowing the headset to interchange between a headband, ear loop and neckband wearing style. The retention element comprises a security element that prevents rotation of the earpiece when coupled, providing a stable and ergonomic wearing experience.

13 Claims, 10 Drawing Sheets

200

300

INTERCHANGEABLE WEARING MODES FOR A HEADSET

BACKGROUND OF THE INVENTION

Headphones and headsets may be configured in various forms for mounting the device to a user's head. Typically the device will by mounted on the user's head using an ear loop, ear bud, headband, neckband or other structure suitable for a head-worn device. Users may choose a particular headset for its mounting form, preferring one form over to another. The user's preference may be due to comfort, ergonomics, or convenience. For example, a user that wears glasses may prefer a headband so that he or she can wear the headset and glasses simultaneously.

SUMMARY OF THE INVENTION

A headset system for interchangeable wearing styles is disclosed. The following description is presented to enable any person skilled in the art to make and use the invention. Descriptions of specific embodiments and applications are provided only as examples and various modifications will be readily apparent to those skilled in the art.

In one embodiment, an apparatus suitable for mounting a sound delivery device on a user's head comprises a mounting element and a retention element. The mounting element is configured to support the apparatus on a user's head. For example, the mounting element may take the form of a headband, ear loop, or neckband.

The retention element may be moveably coupled to the mounting element. The retention element comprises a body configured to retain a sound delivery device and a first securing element configured to resist movement of the sound delivery device relative to the retention element when retained by the retention element.

In another embodiment, the first securing element protrudes from the inner surface and is disposed between the first free end and the second free end. The first securing element may prevent the sound delivery device from moving when the sound delivery device retained by the body. For example, the first securing element may prevent the sound delivery device from rotating about an axis generally parallel to a line stretched between the user's ears when the sound delivery device is retained by the retention element.

The body may have an arcuate portion having an inner surface, a first free end, and a second free end. According to one aspect of the invention, the mounting element is coupled to the retention element near the apex of the arcuate portion.

In another embodiment, the first securing element is a first retention tab disposed at the first free end. The retention element may also comprise a second retention tab disposed at the second free end. The apparatus may also further comprise a release element. The release element may be configured to decouple the retention element from the sound delivery device when the release element is engaged. For example, the apparatus may comprise a first release tab disposed at the first free end and a second release tab disposed at the second free end. The user may press or pull either release element to decouple the retention element from the sound delivery device.

In another embodiment, the retention element may further comprise a second securing element for securing the sound delivery device to the retention element. The sound delivery device may comprise a recess for receiving the second securing element.

In the embodiment where the mounting element is a headband, the retention element is pivotally coupled to the headband and the retention element may pivot about an axis that is generally parallel to a line intersecting the first free end and second free end. The retention element may also be pivotally coupled to the headband such that the retention element may pivot about an axis that is generally perpendicular to a line intersecting the first free end and second free end.

In the embodiment where the mounting element is an ear loop, the retention element is pivotally coupled to the ear loop and the retention element may pivot about an axis that is generally parallel to a line intersecting the first free end and second free end. In the embodiment where the mounting element is a neckband, the retention element is may be detachably coupled to the neckband.

According to another embodiment of the invention, a headset system comprises a first mounting element having a first retaining element and a second mounting element having a second retaining element. The first mounting and second mounting elements are each configured to be mounted on a user's head.

The headset system also comprises an earpiece configured to be interchangeably coupled with at least the first mounting element and the second mounting element. The earpiece may have a recess for receiving the first mounting element and second mounting element. The first retaining element may be configured to prevent movement of the earpiece relative to the first securing element when the first retaining element and earpiece are coupled.

The first mounting element may be in the form of a headband, ear loop, or neckband while the second mounting element may be in the form of an ear loop. The second mounting has a different form factor than the first mounting element. For example, if the first mounting element is a neckband, then the second mounting element may take the form of a headband or ear loop. Additionally, when the first mounting element is a neckband, the first retaining element may be detachably coupled to the neckband.

According to another embodiment of the invention, a headset comprises a sound delivery device, a first mounting means for mounting the headset a sound delivery device, a first mounting means for mounting the headset onto a user's head, a retaining means for detachably coupling the first mounting means to the sound delivery device and a securing means for securing the sound delivery device to the retaining means. The securing means may prevent rotation of the sound delivery device relative to the retaining means. For example, the securing means may prevent the sound delivery device from rotating about an axis generally parallel to a line stretched between the user's ears when the sound delivery device is coupled to the retaining means.

DETAILED DESCRIPTION OF THE DRAWINGS

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Detailed Description of the Drawings as an embodiment of the invention.

As used herein, the term "earpiece" or "earpiece capsule" refers to any object that can be deliver sound to a user's ear. Those skilled in the art will appreciate that the reference to said terms may include in-the-ear, over-the-ear, and/or on-the-ear earpieces without limitation to a specific form factor, and can be, or be part of, a headset, headphone, wearable video camera, wearable computer etc. Furthermore, the earpiece may transmit or receive audio through a wire or wirelessly.

Figure 1B:
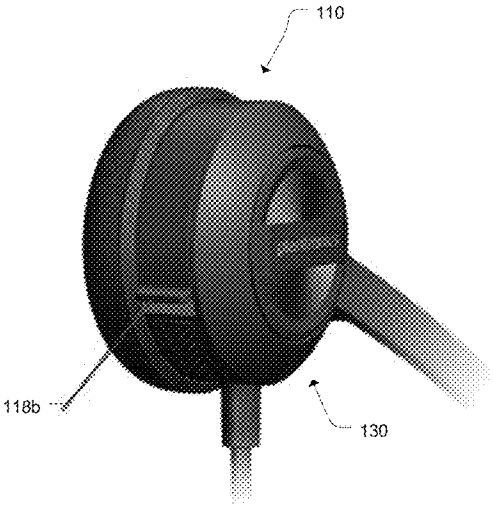
FIG. 1B illustrates the retainer element and earpiece capsule of FIG. 1A when coupled.
Figure 1A:
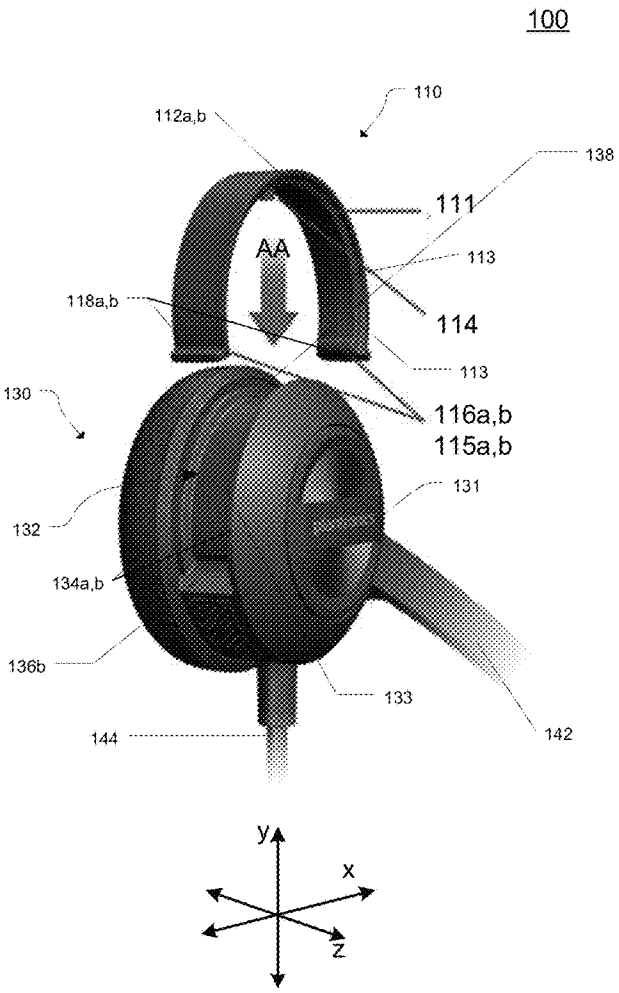
FIG. 1A illustrates a retainer element and earpiece capsule.

Referring to FIG. 1A, shown is a system 100 comprising a retainer element 110 and ear capsule 130 according to one embodiment of the invention. The earpiece capsule 130 comprises a housing 131, a speaker (not shown), recess 132, outer recesses 134*a*/134*b*, retention tab recesses 136*a*/136*b*, and key recess 138. Optionally, the earpiece capsule 130 may also comprise a microphone boom 142 and wire 114 for transmitting audio. The microphone boom 142 includes a microphone at the end thereof and is rotatable, about the Z-axis (i.e. the axis perpendicular to the X and Y axes shown in FIG. 1C) which enables the earpiece to be reversible; it can be used on either the left or right ear. The housing 131 may also contain components commonly known in the art for communication earpieces such as a microphone, PCB board, transceiver, a sensor for detecting if the earpiece is donned, battery, memory, processor and a user interface.

The housing 131 is generally cylindrical and defines recess 132 in an outer surface thereof. The recess 132 comprises a center recess 133, outer recesses 134*a*/134*b*, retention tab recesses 136*a*/136*b*, and key recess 138. As can be seen from FIG. 1, recess 132 forms an upwardly-facing elongate groove into which the speaker capsule 130 may be snapped such that the C-shaped retainer element 110 is located in the groove defined in the speaker capsule. As mentioned above, movement of the retainer element 110 relative to the speaker capsule is thus prevented while the two are so coupled.

The retainer element 110 comprises an inner surface 111, retention tabs 116*a*/116*b*, and release tabs 118*a*/118*b*. In this embodiment, the body of the retainer element 110 is arcuate with two free ends 115*a*/115*b*, resembling a C-shaped clamp. The inner surface 111 comprises a rail 113 defined by surrounding shoulders 112*a*/112*b*. The key element 114 is disposed at the inner surface 111 between free ends 115*a*/115*b*, preferably at the apex of the arc. Retention tabs 116*a*/116*b* are also disposed at the inner surface 111 near free ends 115*a*/115*b* respectively. Release tabs 118*a*/118*b* are disposed on the outer surface of retainer element 110 near the free ends 115*a*/115*b*.

The inner surface 111 is shaped and configured to be complimentary to recess 132 so that when coupled, the retainer element 110 securely retains the earpiece capsule 130. For example, key recess 138 is shaped and configured to receive key element 114. Likewise outer grooves 112*a*/112*b* and outer recesses 134*a*/134*b* are complimentary; rail 113 and center recess 133 are complimentary. Retainer element 110 and housing 131 and their respective elements may be formed from a single piece of material but may also be formed from separate parts and/or materials.

Figure 1C:
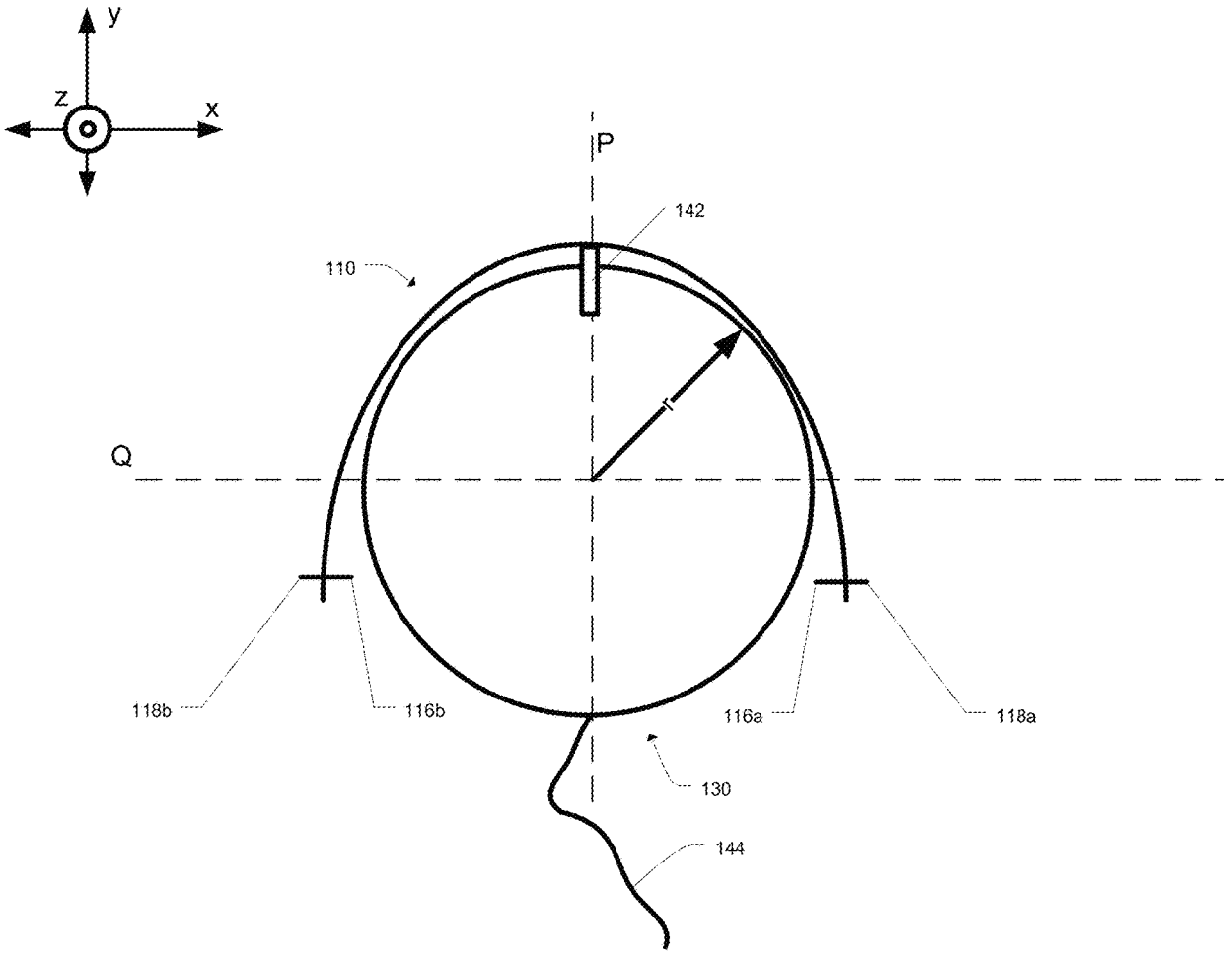
FIG. 1C is a schematic cross-sectional view of the retainer element and earpiece capsule of FIG. 2B.

FIG. 1A shows the retainer element and earpiece capsule when decoupled. FIG. 1B and FIG. 1C shows the retainer element and earpiece capsule of FIG. 1A when coupled. To couple retainer element 110 and earpiece capsule 130 together the user aligns inner surface 110 with recess 130 and forces them together (see arrow AA). The retainer element 110 will engage and "snap" onto the earpiece capsule 130.

Retainer element 110 securely retains the earpiece capsule 130 between free ends 116*a*/116*b*. In this embodiment, retainer element 110 retains the earpiece capsule 130 such the apex of earpiece capsule 130 is aligned along center line P. The wire 144 protrudes from the earpiece capsule 144 at the opposite side of the apex, along center line P. To retain the earpiece capsule 130, the retainer element 110 is configured such that free ends 116*a*/116*b* extend beyond the centerline Q as seen in FIG. 1C. Furthermore, the radius of the retainer element 110 may be appropriately selected to ensure the retainer element 110 sufficiently encompasses housing 131. For example, the radius of the retainer element's arc may be less than or equal to the radius of the housing's radius (see FIG. 1C, radius r). Hence, the retainer element's shape provides compression between free ends 116*a*/116*b* when coupled to the earpiece capsule 130. This compression is partly responsible for resisting the inadvertent decoupling of the retainer element 110 and earpiece capsule 130, and the also keeps the retention tabs 116*a*/116*b* located in the retention tab recesses 136*a*/136*b* in use.

In an alternative embodiment, the retainer element 110 may also retain the earpiece capsule 130 with other fasteners for detachable coupling. For example, system 100 may utilize a magnetic latch system; retainer element 110 and earpiece 130 may comprise magnetic material, preferably at the engaging surfaces. The system 100 may also utilize a traditional button/latch system.

Figure 3D:
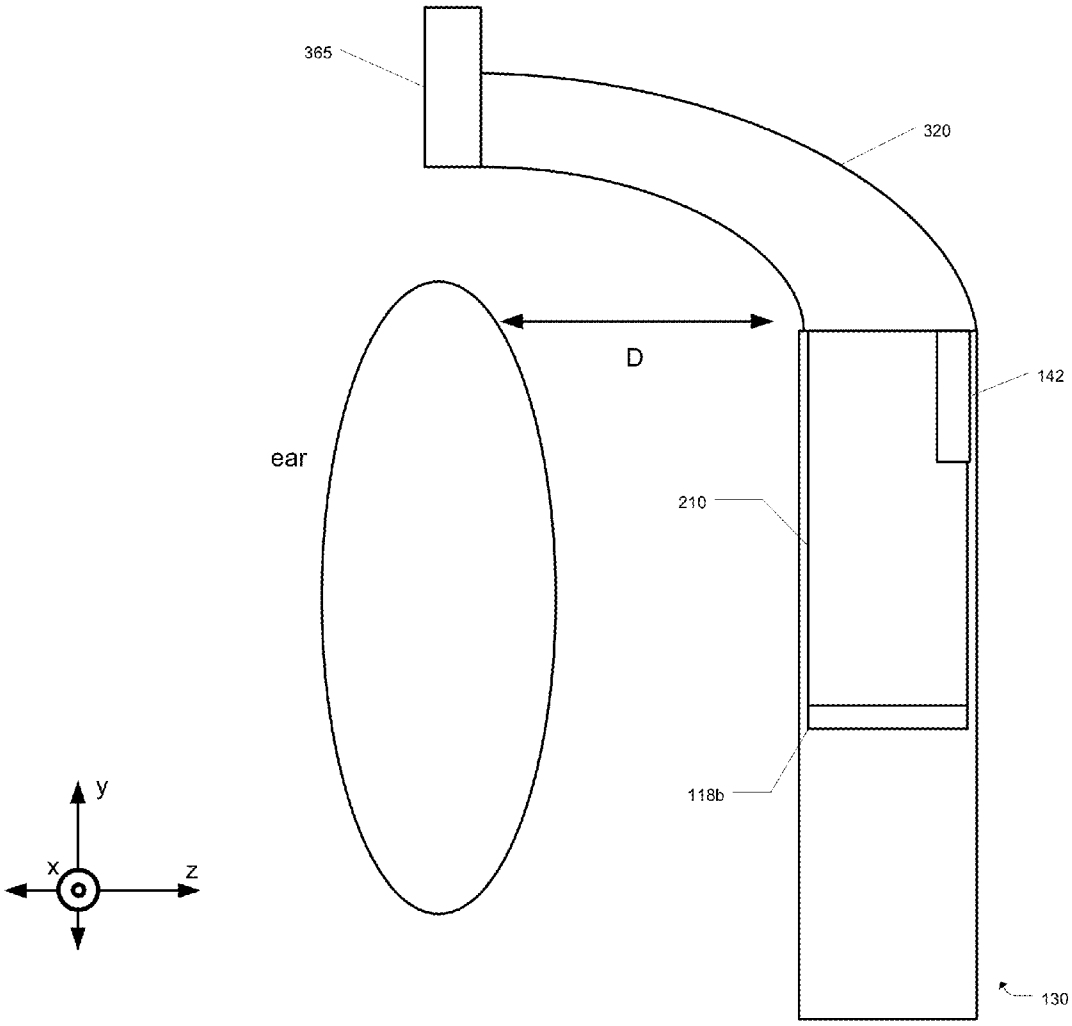
FIG. 3D is a schematic rear view of the headband and earpiece capsule of FIG. 3B.
Figure 4B:
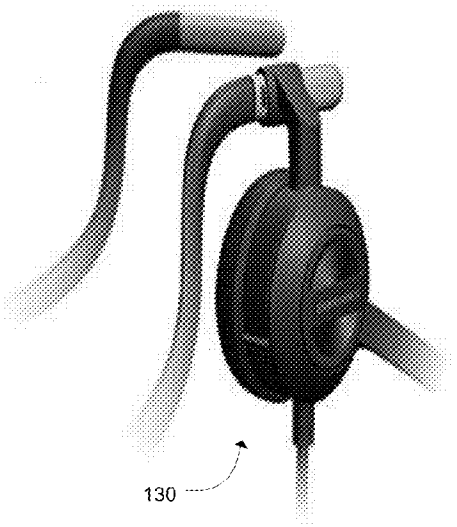
FIG. 4B illustrates the headband of FIG. 4A coupled with an earpiece capsule.

The earpiece capsule 130 is further retained by the key element 114 and key recess 138. When engaged, the key element 114 and key recess 130 prevents the earpiece capsule from rotating about the Z-axis. Furthermore, the key element 114 and key recess 130 may be configured to prevent the retainer element 110 and earpiece capsule 130 from being coupled incorrectly. In one embodiment, the key element 114 and key recess 130 may be offset relative to the longitudinal center of rail 113 and longitudinal center of center recess 138 respectively. For example, the key element 114 may protrude from a portion of the rail 113 and a portion of outer groove 112*b* such that the key element 114 is further away from the user's ear (as seen in FIG. 3D and FIG. 4D). Alternatively, the shape and dimensions of key element 114 and key recess 130 may be non-symmetrical. Furthermore, although one key element/recess combination is shown, it can be appreciated that two or more key element/recess combinations can be used to secure the earpiece capsule.

The retention tabs 116*a*/116*b* in combination with retention tab recesses 136*a*/136*b* also secures the earpiece capsule 130 to the retainer element 110 and prevents rotation about the Z-axis. Although two pairs of retention tabs and tab recesses are shown, it can be appreciated that three or more pairs of retention tabs and tab recesses can be used to secure the earpiece capsule. Furthermore, the pairs may be located anywhere on the engaging surfaces of the retainer element and earpiece capsule.

As discussed above, retainer elements and key elements prevent the retainer element 110 from rotating about the Z-axis when coupled to the ear capsule 130. The prevention is particularly useful when the user rotates the microphone boom 142 about the Z-axis; the microphone boom can to be rotated about the Z-axis while the retainer element and ear capsule are fixed relative to the user's ear.

The surface, shape and dimension of the retainer member 110 may be configured to compliment the earpiece 130 to provide a pleasing and consistent aesthetic when earpiece capsule 130 and retainer element 110 are coupled. For example, referring to FIG. 1B, the retainer element's surface is flush with the surface of the earpiece 130, giving the appearance the module is a single piece unit.

To decouple or detach the earpiece capsule 130 and retainer element 110, the user pulls or pushes release tabs 118*a*/118*b* away from the housing 131 and moves the retainer element in the opposite direction to arrow AA in FIG. 1A. The user may push or pull on both release tabs 118*a*/118*b* at the same time, but it is sufficient that only one release tab is pushed or pulled. Once decoupled, the user may then interchangeably connect another retainer element unit to the earpiece capsule 130. Retainer element may be coupled to various head mounting devices to provide the user with a system of interchangeable wearing modes as described below.

Referring to FIG. 2A-D, a system 200 for an interchangeable headset is shown according to one embodiment of the invention wherein the wearing mode is a headband. The system 200 comprises a headband 250, a retainer element 210, and speaker capsule 130.

Figure 2B:
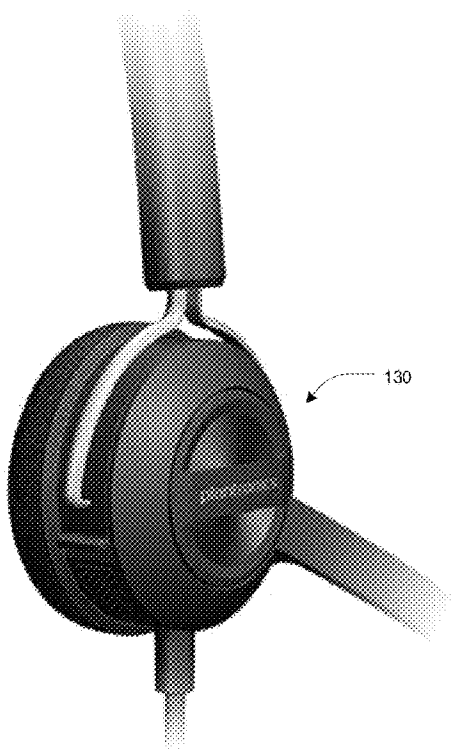
FIG. 2B illustrates the headband of FIG. 2A coupled with an earpiece capsule.
Figure 2A:
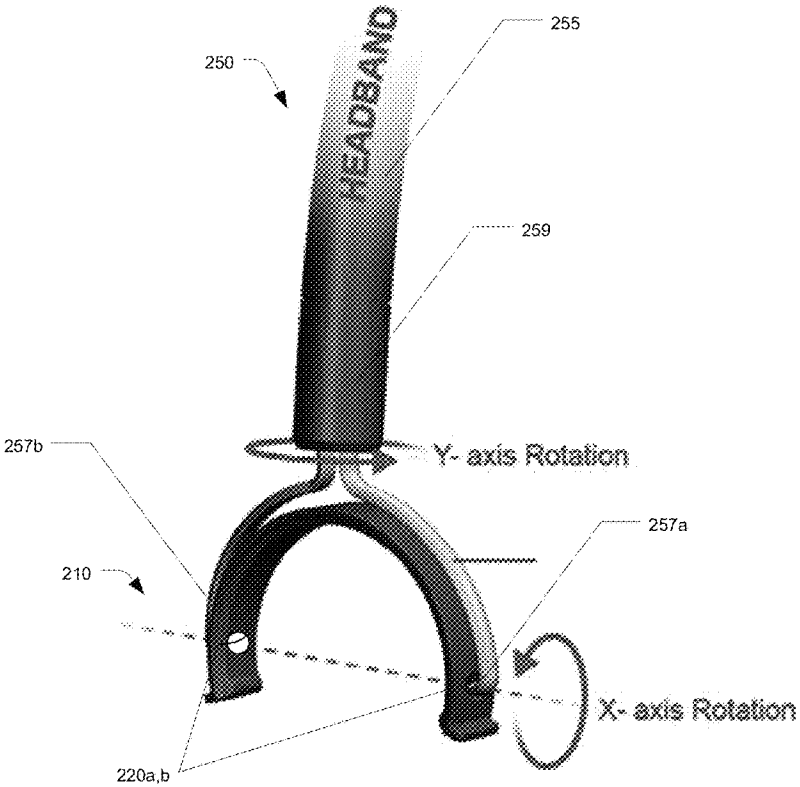
FIG. 2A illustrates a retainer element in the form factor of a headband according to one embodiment of the invention.

Referring to FIG. 2A, the headband 250 comprises a band 255, headband wire 257 and collar 259. In this embodiment, the band 255 is a standard over-the-head band. The length of the band 255 can be adjusted to accommodate various head sizes. On the opposite side of the band 255 (not shown) a similar retainer element for retaining another sound delivery device (if the device is binaural) or a pad (if the device is monaural) is coupled.

The collar 259 is coupled to the band 255 at one end. On the opposite end, the wire 257 is rotatably coupled to collar 259 such that the wire 257 may rotate about the Y-axis. The wire 257 is coupled to the retainer element 210 at two opposite ends 257*a*/257*b*.

The retainer element 210 is similar to retainer element 110 and may differ from structure to facilitate coupling to headband 250. For example, in this embodiment the retainer element 210 comprises a pair of retention holes 220*a*/220*b*. At ends 257*a*/257*b*, the wire is threaded through each retention holes 220*a*/220*b*; end 257*a* is threaded through retention hole 220*a* and end 257*b* is threaded through retention hole 220*b*. After each hole is threaded, each end 257*a* and 257*b* are curved in order to rotatably latch onto retainer element 210 (see FIG. 2C). When coupled to the wire 257, the retainer element 210 is rotatable about the Q-axis.

Figure 2C:
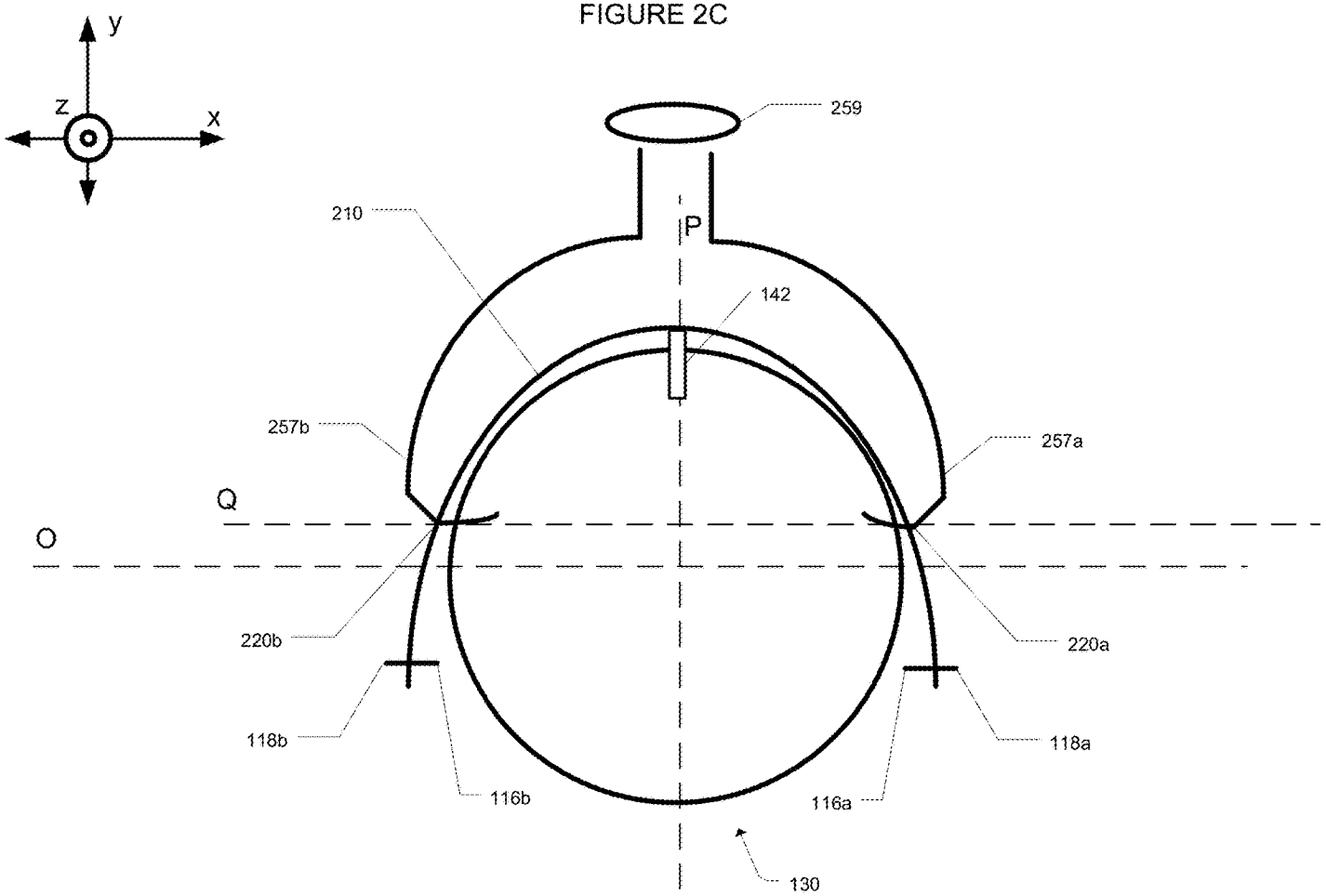
FIG. 2C is a schematic cross-sectional view of the headband and earpiece capsule of FIG. 2B.

Once attached together as shown in FIG. 2B and FIG. 2C, the headband 250 and ear capsule 130 act as a conventional headset or headphone. The ear capsule 130 may pivot about two axes: the P line and Q line (see FIG. 2C). Pivoting about two axes is advantageous as the ear capsule 130 is self-centering when worn in headband mode while conforming to various anatomies. Furthermore, the Q axis may be moved by adjusting the location of the retention holes 220*a*/220*b* and corresponding ends 257*a*/257*b* in order to balance the ear capsule when coupled to the headband. For example, if the ear capsule's center of gravity is located along an axis below center line O (see FIG. 2C), then location of the retention holes 220*a*/220*b* and corresponding ends 257*a*/257*b* may be extended below the center line O such that the Q-axis would be at or near the ear capsule's center of gravity.

Referring to FIG. 3A-D, a system 300 for an interchangeable headset is shown according to another embodiment of the invention wherein the wearing mode is an over-the-ear loop. The system 300 comprises an ear loop 360 a retainer element 310, and speaker capsule 130. The retainer element 310 is similar to retainer element 110 and further comprises a neck 320.

The neck 320 extends a distance D from the retainer element 310's body and is oriented toward the −Z axis. The distance D allows the connection point to the ear loop 360 to be further away from the earpiece capsule 130 (see FIG. 3D). This geometric relationship provides a secure fit without compromising the comfort of the device. The neck 320 is located at or near the apex of the retainer element 310 on the opposing surface of the key element (see FIG. 3C). In an alternative embodiment, the neck may extent in other directions and be located anywhere on the retainer element's surface.

At one end of the neck is a post 365 that is pivotally coupled to the ear loop 360 such that the ear loop 360 may rotate about the Y-axis. The angle of rotation of the ear loop 360 about the post is restricted to ensure ease of donning and proper/correct fitting. Furthermore, the ear loop 360 may frictionally pivot about the post to ensure stability of the device.

Figure 3B:
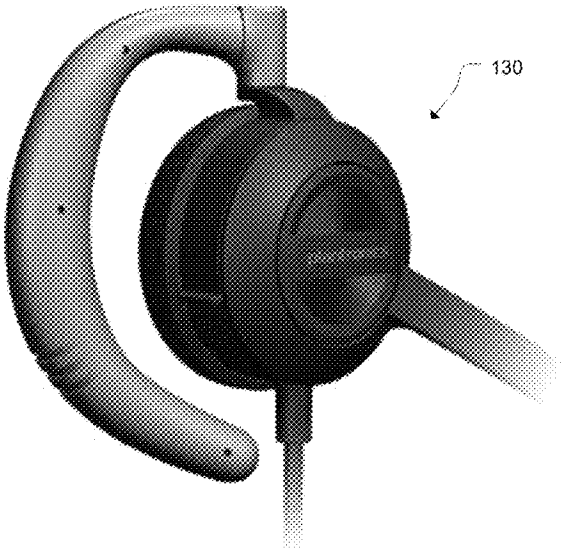
FIG. 3B illustrates the headband of FIG. 3A coupled with an earpiece capsule.
Figure 3A:
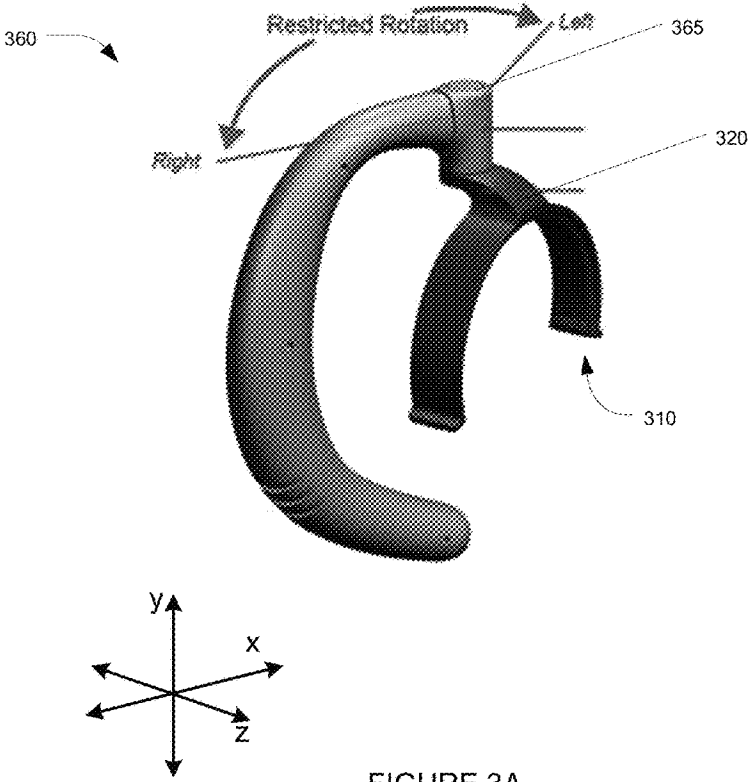
FIG. 3A illustrates a retainer element in the form factor of an over-the-ear loop according to another embodiment of the invention.
Figure 3C:
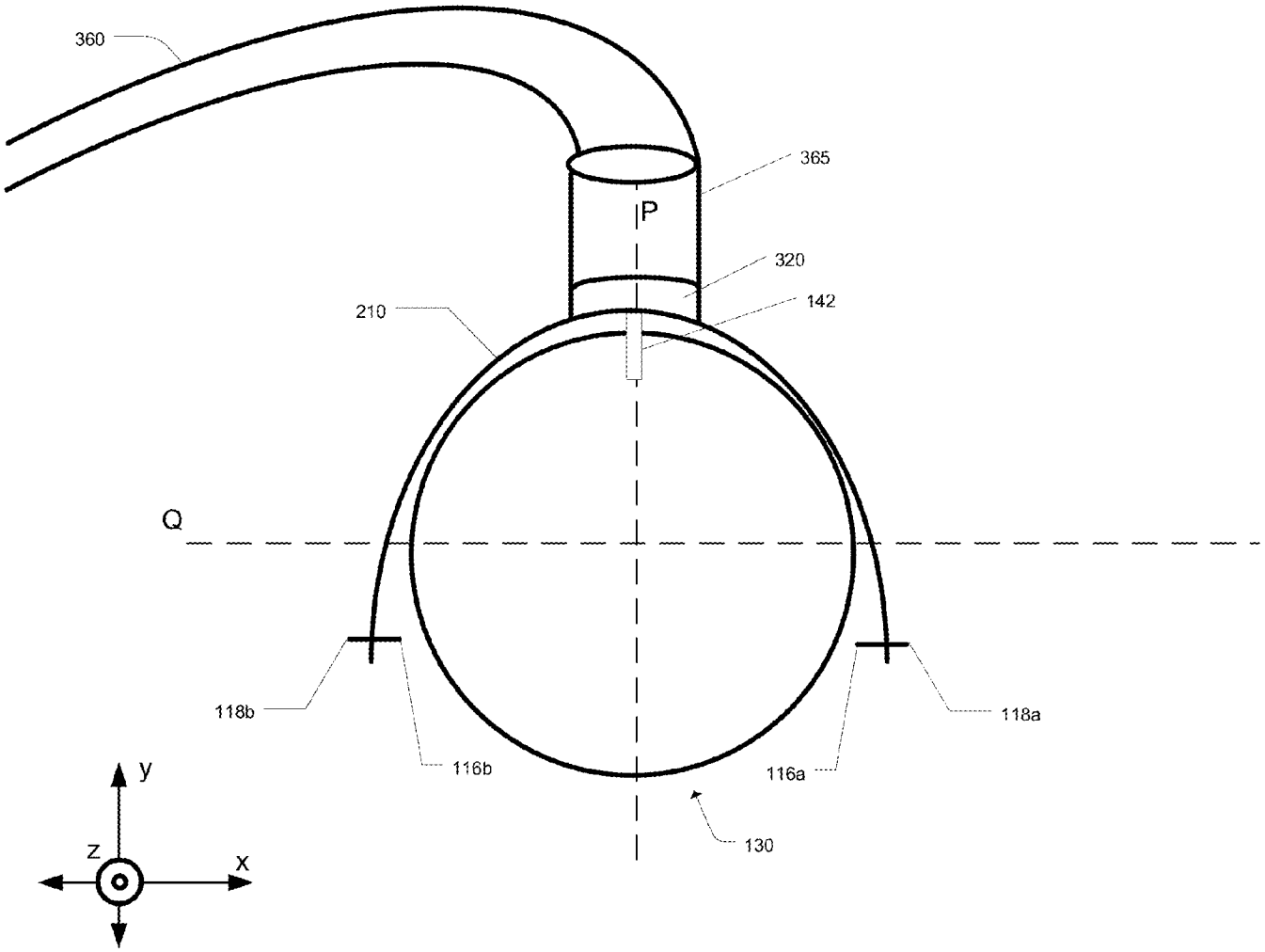
FIG. 3C is a schematic cross-sectional view of the headband and earpiece capsule of FIG. 3B.

Once attached together as shown in FIG. 3B and FIG. 3C, the ear loop 360 and ear capsule 130 act as a conventional headset or headphone. Like the headband embodiment shown in FIGS. 2A-C, the ear loop 360 and earpiece capsule 130 is reversible for left ear and right ear use. Switching between a right ear and left ear configuration is achieved by rotating the ear loop 360 and the microphone boom.

Referring to FIG. 4A-D, a system 400 for an interchangeable headset is shown according to another embodiment of the invention wherein the wearing mode is a neckband. A neckband typically supports a device on a user's head, such as an earpiece, using a band mounted on the back of a user's neck. The system 400 comprises a neckband 469, retainer element 410, and speaker capsule 130.

The neckband 469 comprises a band 470 made of plastic, two free ends 474 and mechanical stops 476. The each free ends 474 of the neckband 469 may be made of or covered by a different material than the band 470. In this embodiment, the free ends 474 are rubber. In an alternative embodiment, both the band 470 and free ends 474 are made from a single piece of material. Disposed on each free end 474 are mechanical stops 476 in the form of a protrusion. Mechanical stops 476 prevent the attachment collars 425 from moving beyond the recommended ergonomic area for the neckband 469.

Figure 4A:
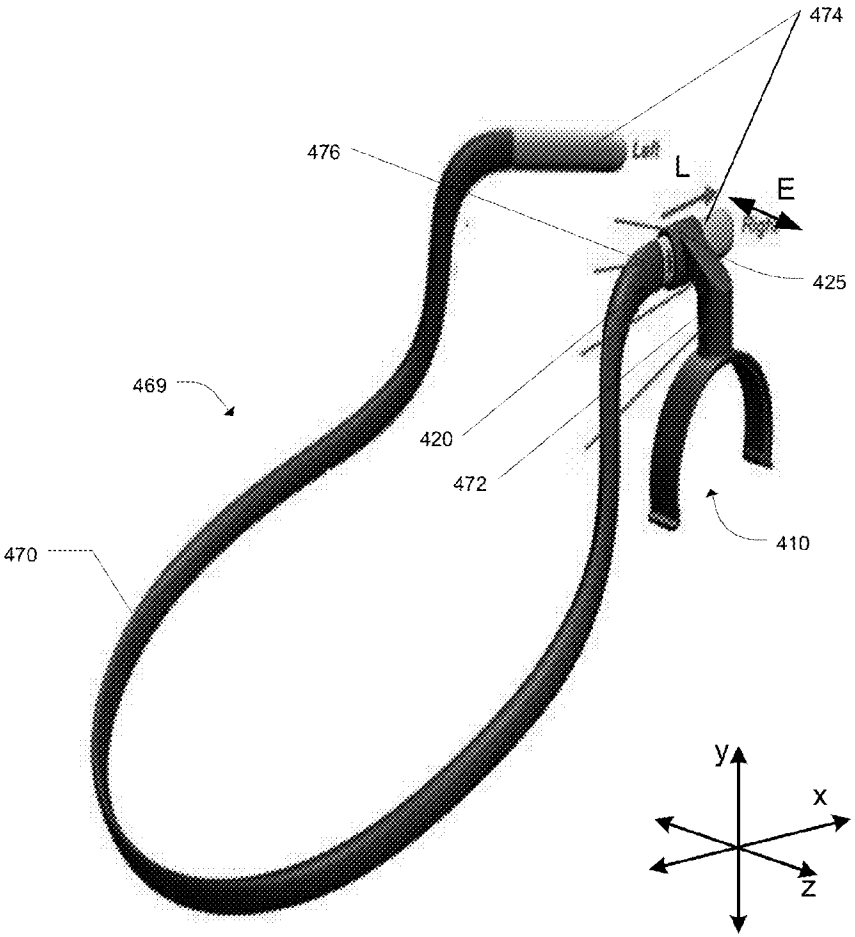
FIG. 4A illustrates a retainer element in the form factor of a neckband according to another embodiment of the invention.

Referring to FIG. 4A, the retainer element 410 comprises a neck 420, an attachment collar 425, and post 472 in addition to other elements previously discussed. The attachment collar 425 is shaped and configured to receive the neckband's free ends 474. According to the embodiment of FIG. 4A, the attachment collar 425 is an oval shaped aperture. To attach the retainer element 410 to the neckband 469, a free end 474 is threaded through attachment collar's aperture. The attachment collar 425 may then frictionally slide across the longitudinal length of the free end (see direction L). To ensure stability attached, the materials comprising free ends 474 and attachment collar 425 would be selected to promote frictional engagement. Also, the attachment collar's inner surface may comprise ribs to increase friction when engaged with a free end 474. To detach the retainer element 410 from the neckband 469, the attachment collar 425 is forced toward the free end in direction L of the neckband 469 until removed.

Similar to retainer element 310, retainer element 410 comprises a neck 420, coupled to the attachment collar 425, which moves the connection point to the neckband 470 away from the earpiece capsule 130 (distance E; see FIG. 4A, 4D). Furthermore, the retainer element 410 comprises a post 472 pivotally coupled to the neck 420. The post 472 is located at or near the apex of the retainer element 310 on the opposing surface of the key element and extends in the Y direction. In an alternative embodiment, the post 472 may extent in other directions and be located anywhere on the retainer element's surface.

The neck 420 is pivotally coupled to the post 474 such that the neck 420 may pivot about the Y-axis. Consequently, when the neckband 469 is coupled to the retainer element 410, rotating the neck 420 about the Y-axis also rotates the neckband 469 about the Y-axis. Furthermore, the neck 720 may frictionally pivot about the post 472 to ensure stability of the device.

Figure 4C:
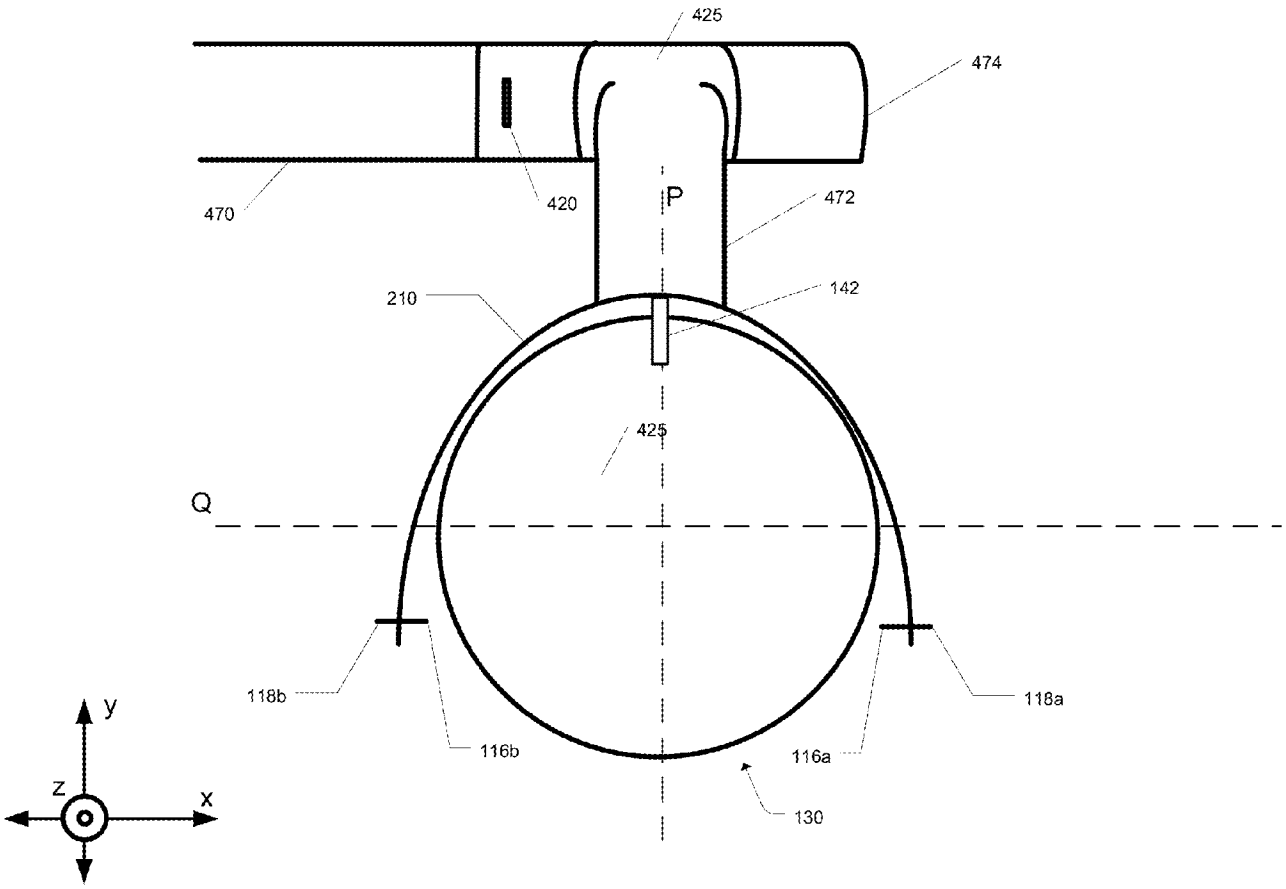
FIG. 4C is a schematic cross-sectional view of the headband and earpiece capsule of FIG. 4B.
Figure 4D:
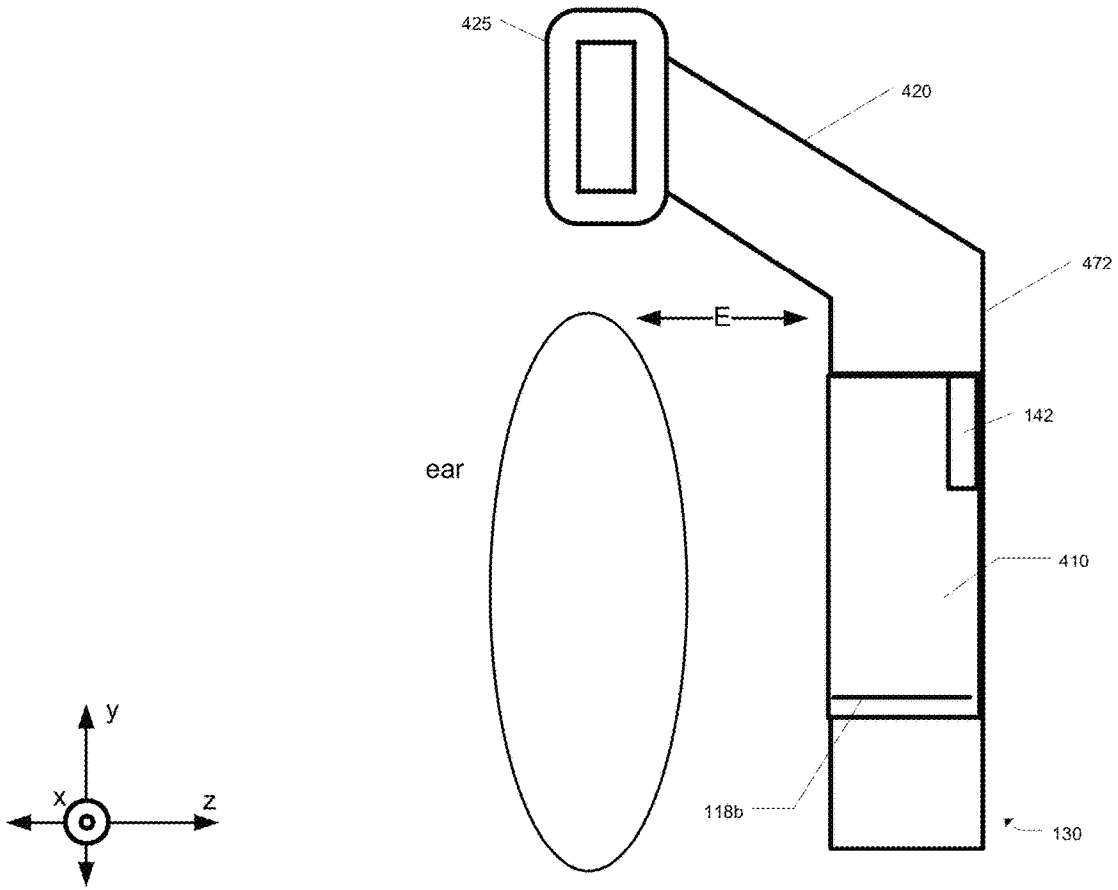
FIG. 4D is a schematic rear view of the headband and earpiece capsule of FIG. 4B.

Once attached together as shown in FIG. 4B and FIG. 4C, the neckband 469 and ear capsule 130 act as a conventional headset or headphone. Like the headband and ear loop embodiments discussed above the neckband is suitable for left ear and right ear use. Switching between a right ear and left ear configuration is achieved by removing the retainer element 410 from one free end 474 and placing it on the other free end 474, then rotating the microphone boom in the appropriate direction.

The embodiments disclosed above provide an interchangeable wearing mode system for a sound delivery device such as a headset. The system provides a user the ability to interchangeably use either a headband, ear loop, or neckband with an earpiece unit. It will be appreciated that any head or body mounting device can be used in conjunction with the retainer element to provide the user with various mounting options. Additionally, the interchangeable systems a consistent and foolproof ergonomic experience in all wearing modes. The ergonomic consistency between all three wearing modes provides tremendous advantage for acoustic and sensor tuning.

What is claimed:

1. A head-mountable sound delivery device, comprising:

a mounting element configured to support the apparatus on a user's head;

a speaker capsule with an external surface having an upwardly-facing elongate groove defined therein;

a C-shaped retention element moveably coupled to the mounting element, into which the speaker capsule may be snapped such that the C-shaped retention element is located in the groove defined in the speaker capsule, thereby to prevent movement of the speaker capsule relative to the C-shaped retention element when the two are engaged, the C-shaped retention element comprising an inner surface, a first free end, and a second free end and a retention formation at each of the first and second free ends that in use engage corresponding retention formations in the speaker capsule.

2. The sound delivery device of claim 1 wherein the mounting element is coupled to the retention element near the apex of the C-shaped retention element.

3. The sound delivery device of claim 1 wherein the first securing element protrudes from the inner surface and is disposed between the first free end and the second free end.

4. The sound delivery device of claim 1 wherein the retention element further comprises a release element, the release element configured to decouple the retention element from the sound delivery device when the release element is engaged.

5. The sound delivery device of claim 1 wherein the mounting element is a headband.

6. The sound delivery device of claim 5, wherein the retention element is pivotally coupled to the headband and the retention element may pivot about an axis that is generally parallel to a line intersecting the first free end and second free end.

7. The sound delivery device of claim 5, wherein the retention element is pivotally coupled to the headband and the retention element may pivot about an axis that is generally perpendicular to a line intersecting the first free end and second free end.

8. The sound delivery device of claim 1 wherein the mounting element is an ear loop.

9. The sound delivery device of claim 8, wherein the retention element is pivotally coupled to the ear loop and retention element may pivot about an axis that is generally perpendicular to a line intersecting the first free end and second free end.

10. The sound delivery device of claim 1 wherein the mounting element is a neckband.

11. The sound delivery device of claim 10 wherein the retention element is detachably coupled to the neckband.

12. The sound delivery device of claim 1 wherein the retention formations at the first and second free ends comprise a first retention tab disposed at the first free end and a second retention tab disposed at the second free end.

13. The sound delivery device of claim 12 further comprises a first release tab disposed at the first free end and a second release tab disposed at the second free end.

* * * * *